US007077599B1

(12) United States Patent
Hughes, Jr.

(10) Patent No.: US 7,077,599 B1
(45) Date of Patent: Jul. 18, 2006

(54) FLEXIBLE TRAFFIC CONTROL MARKER

(76) Inventor: Robert K. Hughes, Jr., 2150 Andrea La., #C, Fort Myers, FL (US) 33912

( * ) Notice: Subject to any disclaimer, the term of this patent is extended or adjusted under 35 U.S.C. 154(b) by 0 days.

(21) Appl. No.: 11/248,626

(22) Filed: Oct. 12, 2005

Related U.S. Application Data

(60) Provisional application No. 60/618,059, filed on Oct. 12, 2004.

(51) Int. Cl.
*E01F 9/00* (2006.01)

(52) U.S. Cl. ..... 404/10; 404/9; 116/63 R

(58) Field of Classification Search ..... 404/9, 404/10; 116/63 R; 403/10
See application file for complete search history.

(56) References Cited

U.S. PATENT DOCUMENTS 1,668,288 A * 5/1928 Schrank ..... 404/10
1,766,841 A * 6/1930 Sherman ..... 404/10
3,850,536 A * 11/1974 Kone ..... 404/11
4,462,711 A * 7/1984 Garner ..... 404/10
4,596,489 A * 6/1986 Mariol et al. ..... 404/10
4,958,954 A * 9/1990 Schmanski et al. ..... 404/10
6,109,820 A 8/2000 Hughes, Sr.

* cited by examiner

*Primary Examiner*—Gary S. Hartmann
(74) *Attorney, Agent, or Firm*—Bracewell & Giuliani LLP

(57) ABSTRACT

A roadway marker has a pair of ramps, each inclining upward from a base toward the other. A slot is located between the ramps. On end of the slot is closed, while the other end of the slot has a pair of tabs that partially close the slot, leaving a gap between them. A flexible marker strip protrudes upward from the ramps and has a lower portion extending into the slot. The marker strip having a thickness less than the gap to enable the marker strip to be inserted into the slot from an end of the slot. The lower end of the marker is bent and extends into a lateral leg of the slot to prevent upward movement of the marker.

9 Claims, 3 Drawing Sheets

FLEXIBLE TRAFFIC CONTROL MARKER

CROSS-REFERENCE TO RELATED APPLICATION

This application claims priority to provisional application Ser. No. 60/618,059, filed Oct. 12, 2004.

FIELD OF THE INVENTION

The invention relates generally to traffic control devices, and more particularly to a base and flexible marker for traffic control purposes.

BACKGROUND OF THE INVENTION

Traffic control devices utilized on roadways or other marking areas are frequently struck by vehicles, and if the traffic control device is not adequately secured in place, the device is often displaced from its intended location. Examples of commonly used traffic control devices include the use of traffic cones. To prevent inadvertent displacement of traffic control devices such as traffic cones, a traffic control device is needed that remains in place even when struck by a vehicle.

Another prior version of a traffic control device is a wide flexible highway marker secured within an arcuate base. Such prior versions of this type of traffic control device, however, featured a multiplicity of parts and required multiple steps to properly assemble the traffic control device. Additionally, each of the parts included in such prior versions are naturally subject to wear over time.

It is desirable in the art to provide a wide flexible highway marker which minimizes the number of parts and minimizes the number of steps required to properly assemble the marker device, while maintaining the same optimum performance as the previous wide flexible highway markers when vehicles deflect them on the roadway or other marking area.

SUMMARY OF THE INVENTION

In this invention, a pair of ramps is located on a base in alignment with each other. A slot is formed between elevated ends of the ramp. A flexible marker strip protrudes upward from the ramps and has a lower portion extending into and being retained in the slot against upward movement. Lateral retainers are located at opposite ends of the slot to prevent lateral movement of the marker strip.

Preferably, the lateral retainer at one end is an end wall extending between the ramps and closing off that end of the slot. The lateral retainer at the other end preferably comprises a pair of tabs, one on each of the ramps. Each tab extends partially into the slot and is separated from the other tab by a gap to allow the lower portion of the marker strip to be inserted into the slot.

The slot preferably has an upright portion and a retaining portion located below and having a greater width than the upright portion. The lower portion of the marker strip has a retaining portion integrally formed with the marker strip and extending laterally therefrom into the retaining portion of the slot to retain the marker strip against upward movement. In the preferred embodiment, the lower end of the marker strip is bent, forming the retaining portion.

DETAILED DESCRIPTION OF THE INVENTION

Although the following detailed description contains many specific details for purposes of illustration, anyone of ordinary skill in the art will appreciate that many variations and alterations to the following details are within the scope of the invention. Accordingly, the exemplary embodiment of the invention described below is set forth without any loss of generality to, and without imposing limitations thereon, the claimed invention.

Figure 1:
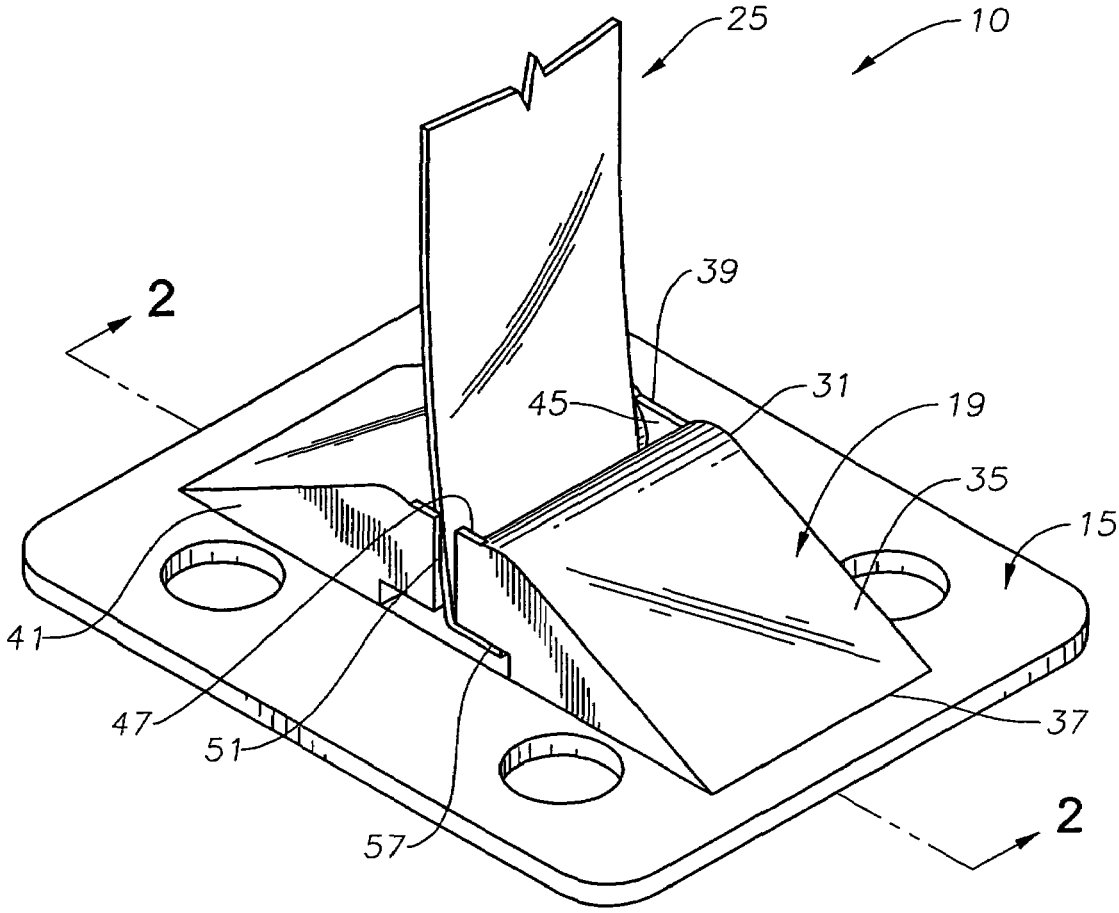
FIG. 1 is an isometric view of a traffic control apparatus in accordance with the invention.

Referring to FIG. 1, a traffic control assembly 10 for marking roadways or other marking areas is shown. The embodiment of the traffic control assembly 10 shown in FIG. 1 generally includes a horizontal base 15, a pair of ramps 19, and a flexible marker strip 25 extending substantially vertically from the ramps 19 when in a non-impacted and non-deformed state.

Figure 3:
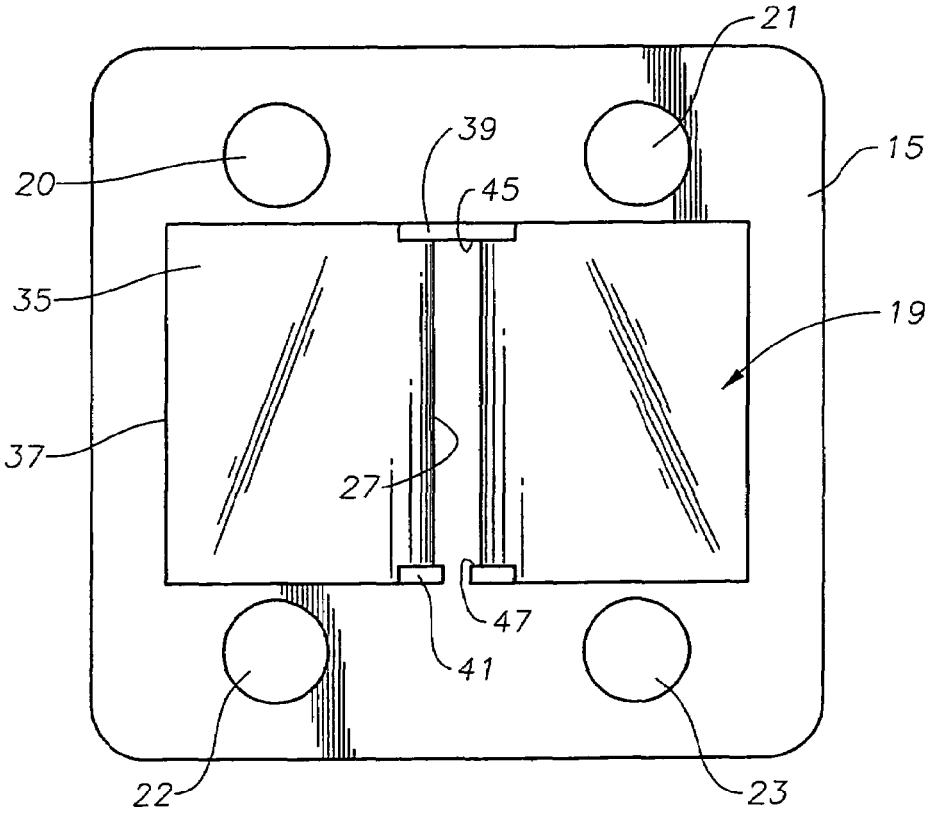
FIG. 3 is a top plan view of the traffic control apparatus of FIG. 1 with the flexible marker removed.

The foundation or base 15 is a plastic plate facing vertically upward and having a thickness of about an inch. The shape of the flat side of the base 15 may be square, rectangular, or alternatively any other suitable shape. The base 15 includes four holes 20, 21, 22, 23 spaced apart toward the four corners of the base 15, as shown in FIG. 3, for mounting the base 15 to a roadway or other marking area. The holes 20, 21, 22, 23 may receive fasteners such as screws for mounting the base 15 to the roadway. Alternatively, the base 15 may be mounted to the roadway with an adhesive such as epoxy applied to its underside, whereby the adhesive fills the holes 20, 21, 22, 23 when the underside of the base 15 is pressed against the roadway.

A pair of ramps 19 is composed of a high density plastic or rubber material and preferably integrally formed with base 15. Ramps 19 are on the flat side of the base 15 toward the center portion of the plate 15, positioned inside of the holes 20, 21, 22, 23 on the plate 15. Each ramp 19 is rectangular in shape when viewed from the top, as shown in FIG. 3, but may also be square or any other suitable shape.

Figure 2:
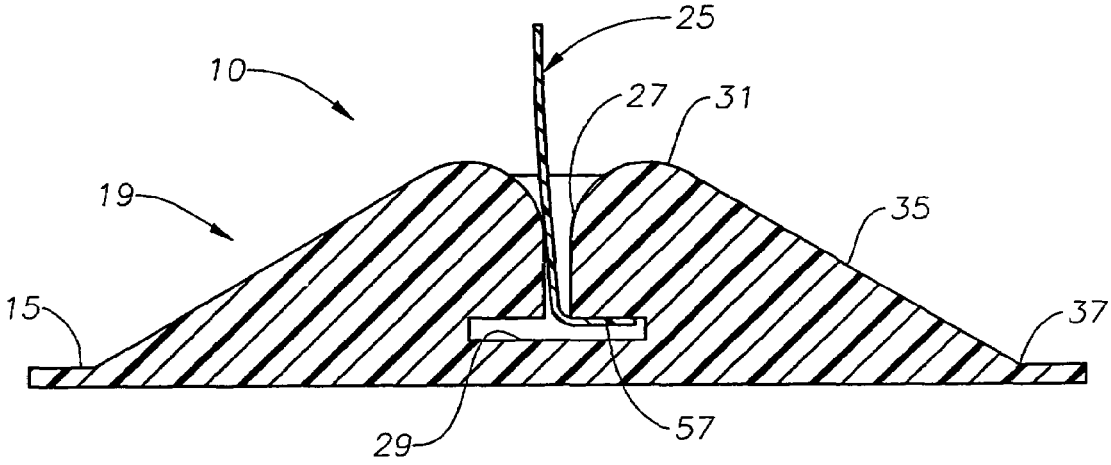
FIG. 2 is a sectional side view of the traffic control apparatus of FIG. 1 taken along the line 2—2 of FIG. 1.

Referring to FIG. 2, ramps 19 are separated by a slot 27 that extends vertically. Slot 27 has a retainer or horizontal portion 29 joining the vertical portion of slot 27. The horizontal slot 29 is embedded within ramps 19 toward the bottom center of ramps 19. Horizontal slot 29 extends laterally from slot 27. Each ramp 19 has an elevated end that comprises a curvilinear or arcuate portion 31 parallel to the vertical slot 27 and located on each side of the vertical slot 27. The arcuate portions 31 extend upward and outward from the vertical slot 27. The curve of the arcuate portions 31 extends upward from the vertical slot 27 with the apex of each arcuate portion 31 located a selected distance away from the vertical slot 27. Each arcuate portion 31 extends in a smooth uninterrupted manner from one end of slot 27 to the other.

Each ramp 19 has a flat inclined surface 35 that extends from a point 37 on base 15 to arcuate portion 31. Inclined surfaces 35 extend outward and downward from arcuate portions 31 at an angle from the horizontal, as shown in FIG. 2. The preferable angle for the inclined surfaces 35 is approximately 30 degrees from the horizontal, but the inclined surfaces 35 may alternatively feature other suitable angles. The inclined surfaces 35 lessen the likelihood that the flexible marker 25 will break when deflected.

Ramps 19 have a closed wall 39 at one end of slot 27 that extends vertically downward from the top of the arcuate segments 31 into contact with the base 15. The closed wall 39 continues uninterrupted from ramp 19 longitudinally to the other ramp 19. In this manner, the inside portion 45 of the closed wall 39 operates as a barrier at one side of the vertical slot 27, so that when the flexible marker 25 is fitted within the vertical slot 27, it is bounded by the inside portion 45 of the closed wall 39.

A pair of tabs 41 is located on ramps 19 on the end of slot 27 opposite the closed wall 39. Each tab 41 protrudes from one of the ramps 19 toward the other. Tabs 41 extend toward each other but are separated by a gap 51. Each tab 41 has a surface 47 that faces surface 45 of closed wall 39. Each tab 41 has a lower end at the upper edge of horizontal slot 29. Horizontal slot 29 is completely open on the side containing the tabs 41.

Gap 51, which is located between tabs 41, has a width slightly less than the width of the vertical slot 27. Gap 51 operates as a passage through which a lower portion of flexible marker 25 slides past tabs 41 and into the vertical and horizontal slots 27, 29. In this manner, the tabs 41 operate as a barrier for the flexible marker 25 inside the vertical and horizontal slots 27, 29. The bottom portion 57 of the flexible marker 25 is bent at approximately a 90 degree angle for alignment of the bottom portion 57 with the horizontal slot 29.

When the flexible marker 25 is secured within the vertical and horizontal slots 27, 29 and is pressed against one of the arcuate portions 31 of the ramps 19, the tabs 41 restrain the flexible marker 25 therein. Even when the flexible marker 25 and the traffic control assembly 10 is physically impacted, the marker 25 remains secured between the closed wall 39 and the surfaces 47 of the tabs 41, which prevents the marker 25 from sliding out of the slot 27.

In the preferred embodiment, which is one of many possible embodiments, the flexible marker 25 has a vertically extending length of about 3 feet, and a thickness of about ⅛ inch. The flexible marker 25 has a width of approximately 3.5 inches, which is substantially similar to the distance between the inside portion 45 of the closed wall 39 and the inside surface 47 of the tabs 41. In order to slide the flexible marker 25 through gap 51, the marker 25 is held in vertical alignment with gap 51 and vertical slot 27. The bottom portion 57 of the flexible marker 25 is bent at approximately a 90 degree angle for alignment of the bottom portion 57 with the horizontal slot 29. An operator slides the flexible marker 25 through gap 51 and secures the marker 25 into a settled position between the inside portion 45 of the closed wall 39 and inside surface 47 of tabs 41.

The flexible marker 25 is a rectangular, visibly coated warning device. When placed on a roadway, the base 15 and the ramps 19 are designed to support the flexible marker 25 in an upright position during normal non-impacted use, and thus alert automobile drivers of roadway conditions. The flexible marker 25 may have a flat smooth surface, or alternatively may be ribbed with longitudinal stiffening ribs along its length. The flexible marker 25 may also be curved, oblong, or tubular in shape.

The flexible marker 25 is sufficiently thick to resist casual bending or flexing along its length from forces such as a strong wind. As such, the marker 25 remains substantially vertically upright when in a non-deformed state when the marker 25 is not forcibly impacted by a physical object. The flexible marker 25 is sufficiently thin and flexible so that the marker 25 will elastically deform along its length when a physical object forcibly applies a significant impact on the flexible marker 25, such as by a moving vehicle or automobile.

Figure 4:
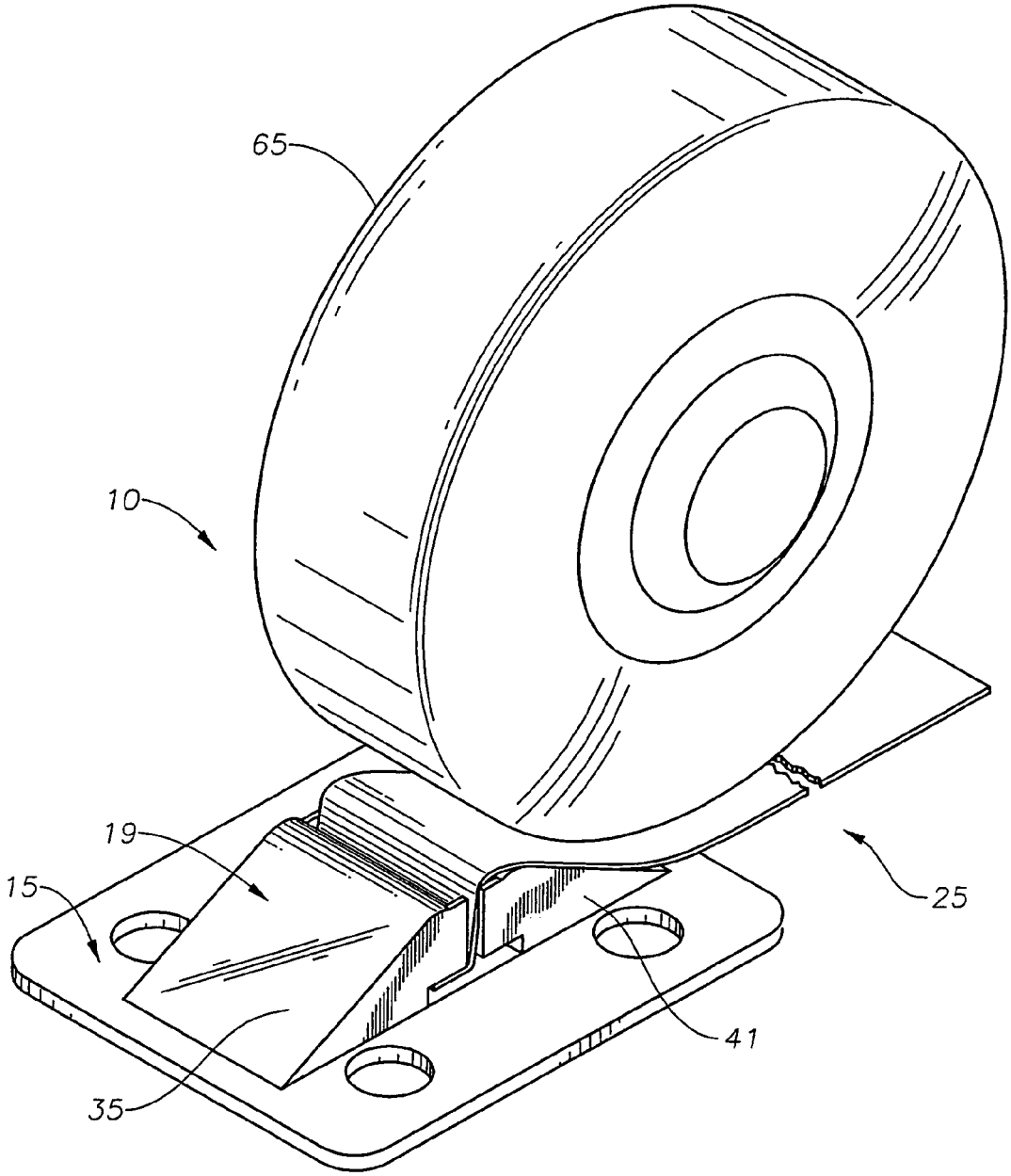
FIG. 4 is an isometric view of the apparatus of FIG. 1 showing the marker undergoing deformation.

In operation, referring to FIG. 4, when a moving vehicle (not shown) strikes the traffic control assembly 10, it is designed to allow the flexible marker 25 to elastically deform before returning to an upright position after impact. When the tire 65 of the vehicle strikes the traffic control assembly 10, the tire 65 rolls onto one of the ramps 19 and one of the arcuate portions 31 before striking the flexible marker 25. Upon impact from the tire 65, the marker 25 flexes or bends to a position along the angle of the ramp inclined surface 35 under the weight of the vehicle. During deformation, arcuate portions 31 allow the flexible marker 25 to flex or bend about the radius of the arcuate portions 31 rather than making a sharp 90 degree bend. The bottom portion 57 of the flexible marker 25 remains securely affixed within ramps 19. After the vehicle and tire 65 move past the traffic control assembly 10, the resilient elastic properties of the flexible marker 25 allow it to return to an upright position.

The invention has several important advantages. The traffic control assembly effectively warns automobile drivers of the condition or presence of the roadway, such that when impacted the traffic control assembly is not displaced from its previous intended position. The invention minimizes the number of parts required to construct the traffic control assembly. The invention also minimizes the number of steps required to properly assemble the traffic control assembly. Further, while minimizing the number of parts and steps of assembly, the invention maintains the same optimum performance as the previous wide flexible highway markers in the industry when vehicles deflect them on the roadway or on another marking area.

Although some embodiments of the present invention have been described in detail, it should be understood that various changes, substitutions, and alterations can be made hereupon without departing from the principle and scope of the invention. Accordingly, the scope of the present invention should be determined by the following claims and their appropriate legal equivalents.

I claim:

1. A roadway marker, comprising:

a base;

a pair of ramps on the base in alignment with each other, each having an elevated end spaced from the elevated end of the other ramp;

a slot located between the elevated ends, the slot having a first end at a first side of the ramps and a second end at a second side of the ramps;

a flexible marker strip protruding upward from the ramps and having a lower portion extending into and being retained in the slot against upward movement;

lateral retainers at the first end and second ends of the slot to prevent lateral movement of the marker strip in the first and second directions; and wherein the lateral retainer at the first end comprises a pair of tabs, one on each of the ramps, each tab extending into the slot from its respective ramp toward the other tab but separated by a clearance so as to allow the lower portion of the marker strip to be inserted into the slot from the first end of the slot.

2. The marker according to claim 1, wherein the lateral retainer at the second end comprises an end wall extending between the ramps and closing off the second end of the slot.

3. The marker according to claim 1, wherein the slot comprises:

an upright portion and a retaining portion located below and having a greater width than the upright portion; and wherein the lower portion of the marker strip has a retaining portion integrally formed with the marker strip and extending laterally therefrom into the retaining portion of the slot to retain the marker strip against upward movement.

4. The marker according to claim 1, wherein the slot comprises:

an upright portion and a retaining portion at a lower end of the upright portion and extending laterally from the upright portion; and wherein the lower portion of the marker strip has a retaining portion that extends laterally therefrom into the retaining portion of the slot to retain the marker strip against upward movement.

5. The marker according to claim 1, wherein the slot comprises:

an upright portion and a retaining portion at a lower end of the upright portion and extending laterally from the upright portion; and wherein the lower portion of the marker strip is bent and extends laterally into the retaining portion of the slot to retain the marker strip against upward movement.

6. The marker according to claim 1, wherein the marker has a constant thickness from a first side edge to a second side edge.

7. The marker according to claim 1, wherein each of the ramps comprises:

a flat inclined surface extending from the base to the elevated end; and wherein the elevated end comprises a curvilinear surface.

8. The marker according to claim 1, wherein each of the ramps comprises:

an inclined surface located in a single plane from the base to the elevated end; and wherein a junction of each of the elevated ends with the slot is a curved surface extending uninterrupted from the first end to the second end of the slot.

9. A roadway marker, comprising:

a base;

a pair of ramps integrally formed with the base, each inclining upward from the base to a rounded elevated end;

the elevated ends being spaced apart from each other, defining a vertical portion of a slot therebetween;

the slot having a lateral portion extending laterally from a lower end of the vertical portion;

a flexible marker strip having a lower end that is bent laterally and inserted into the lateral portion of the slot, the marker strip extending upward through the vertical portion of the slot;

a closure wall extending across one end of the slot; and a pair of retainers at an opposite end of the slot, partially blocking the opposite end of the slot.

* * * * *